US009761232B2

(12) United States Patent
Jo et al.

(10) Patent No.: US 9,761,232 B2
(45) Date of Patent: Sep. 12, 2017

(54) MULTI-DECODING METHOD AND MULTI-DECODER FOR PERFORMING SAME

(71) Applicant: SAMSUNG ELECTRONICS CO., LTD., Suwon-si, Gyeonggi-do (KR)

(72) Inventors: Seok-hwan Jo, Suwon-si (KR); Chang-yong Son, Gunpo-si (KR); Do-hyung Kim, Hwaseong-si (KR); Kang-eun Lee, Hwaseong-si (KR); Si-hwa Lee, Seoul (KR)

(73) Assignee: SAMUSNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/024,266

(22) PCT Filed: Sep. 29, 2014

(86) PCT No.: PCT/KR2014/009109

§ 371 (c)(1),
(2) Date: Mar. 28, 2016

(87) PCT Pub. No.: WO2015/046991

PCT Pub. Date: Apr. 2, 2015

(65) Prior Publication Data

US 2016/0240198 A1 Aug. 18, 2016

(30) Foreign Application Priority Data

Sep. 27, 2013 (KR) ..... 10-2013-0115432

(51) Int. Cl.
*G10L 19/008* (2013.01)

(52) U.S. Cl.
CPC ..... *G10L 19/008* (2013.01)

(58) Field of Classification Search
CPC ..... G10L 19/008
USPC ..... 704/500
See application file for complete search history.

(56) References Cited

U.S. PATENT DOCUMENTS 6,094,636 A * 7/2000 Kim ..... G10L 19/005 375/E7.184
6,970,526 B2 * 11/2005 Min ..... G06T 9/007 331/17
7,062,429 B2 * 6/2006 Faller ..... H04B 1/665 375/240.08
8,213,518 B1 * 7/2012 Wang ..... H04N 19/44 348/721

(Continued)

FOREIGN PATENT DOCUMENTS

KR 10-2012-0096592 8/2012
KR 10-2013-0103553 9/2013
WO WO 2008/043670 A1 4/2008

OTHER PUBLICATIONS

International Search Report issued Dec. 24, 2014 in corresponding International Patent Application No. PCT/KR2014/009109.

*Primary Examiner* — Edwin S Leland, III
(74) *Attorney, Agent, or Firm* — Staas & Halsey LLP

(57) ABSTRACT

A multi-decoding method, according to the present invention, comprises the steps of: receiving a plurality of bitstreams, dividing decoding modules for decoding the plurality of bitstreams according to a data amount of an instruction cache, and cross-decoding the plurality of bitstreams using each of the divided decoding modules.

18 Claims, 11 Drawing Sheets

(56) References Cited

U.S. PATENT DOCUMENTS

| | | | | |
|---|---|---|---|---|
| 8,762,644 | B2 | 6/2014 | Castelloe | |
| 9,154,791 | B2 * | 10/2015 | Goel | H04N 19/176 |
| 2008/0086599 | A1 * | 4/2008 | Maron | G06F 12/126 711/133 |
| 2008/0187053 | A1 * | 8/2008 | Zhao | H04N 19/513 375/240.25 |
| 2009/0006103 | A1 * | 1/2009 | Koishida | G10L 19/167 704/500 |
| 2009/0070119 | A1 * | 3/2009 | Yoo | G06F 1/3203 704/500 |
| 2009/0279801 | A1 * | 11/2009 | Ohmiya | H04N 19/105 382/238 |
| 2010/0114582 | A1 * | 5/2010 | Beack | H04S 7/30 704/500 |
| 2011/0035226 | A1 * | 2/2011 | Mehrotra | G10L 21/038 704/500 |
| 2011/0150085 | A1 * | 6/2011 | Andrijanic | H04N 19/176 375/240.12 |
| 2011/0173004 | A1 * | 7/2011 | Bessette | G10L 19/005 704/500 |
| 2011/0289276 | A1 * | 11/2011 | O'Sullivan | G06F 9/3004 711/122 |
| 2012/0096223 | A1 * | 4/2012 | Castelloe | G06F 1/3275 711/118 |
| 2014/0067404 | A1 * | 3/2014 | Baumgarte | G10L 19/008 704/500 |
| 2014/0358554 | A1 * | 12/2014 | Riedmiller | G10L 19/002 704/500 |
| 2015/0348558 | A1 * | 12/2015 | Riedmiller | G10L 19/018 704/500 |
| 2016/0029138 | A1 * | 1/2016 | France | G10L 19/008 381/23 |
| 2016/0234520 | A1 * | 8/2016 | Goel | H04N 19/426 |
| 2016/0234521 | A1 * | 8/2016 | Goel | H04N 19/44 |

* cited by examiner

MULTI-DECODING METHOD AND MULTI-DECODER FOR PERFORMING SAME

CROSS-REFERENCE TO RELATED APPLICATIONS

This application is a U.S. National Stage Application, which claims the benefit under 35 U.S.C. §371 of PCT International Patent Application No. PCT/KR2014/009109, filed Sep. 29, 2014, which claims the foreign priority benefit under 35 U.S.C. §119 of Korean Patent Application No. 10-2013-0115432, filed Sep. 27, 2013, the contents of which are incorporated herein by reference.

TECHNICAL FIELD

The present invention relates to a multi-decoding method of simultaneously processing a plurality of audio signals and a multi-decoder for performing the same.

BACKGROUND ART

In the case of a multi-decoder included in recent audio devices, a plurality of decoders operate to decode not only a main audio signal but also associated audio signals. However, most multi-decoders include a converter or a transcoder to be compatible with other multimedia equipment, and employ a decoder requiring a high throughput to transmit many audio bitstreams without compromising sound quality. In order to raise system competitiveness while using such a decoder requiring a high throughput at optimal performance in an environment having limited resources, it is necessary to reduce costs.

When a multi-core processor digital signal processor (DSP) is used in a multi-decoder, parallel processing is possible between decoders, and thus a processing rate is increased. However, costs increase due to an increase in the number of cores and an increase in an independent memory demand of each decoder.

On the other hand, when a single-core DSP is used, since a memory required by decoders may be shared and used in a single core, costs can be reduced. However, a processing rate is reduced due to an increase in additional memory access required for switching between decoders during sequential processing among the decoders.

Therefore, it is necessary to develop a multi-decoding method for reducing costs and also increasing a processing rate.

DETAILED DESCRIPTION OF THE INVENTION

Technical Problem

Provided is a multi-decoding method for reducing costs and also increasing a processing rate using a single-core processor.

In particular, a multi-decoding method for reducing a stall cycle of an instruction cache through an improvement in a decoding structure is provided.

Technical Solution

Decoding modules are divided according to a data amount of an instruction cache, and a plurality of bitstreams are cross-decoded using each of the divided decoding modules.

Advantageous Effects of the Invention

By minimizing occurrence of cache misses, it is possible to reduce a stall cycle, so that an overall decoding rate can be increased.

Also, by storing instruction codes in a main memory according to a sequence in which decoding modules are processed, it is possible to minimize duplicate caching of the instruction codes and increase a decoding rate.

BEST MODE

Figure 1:
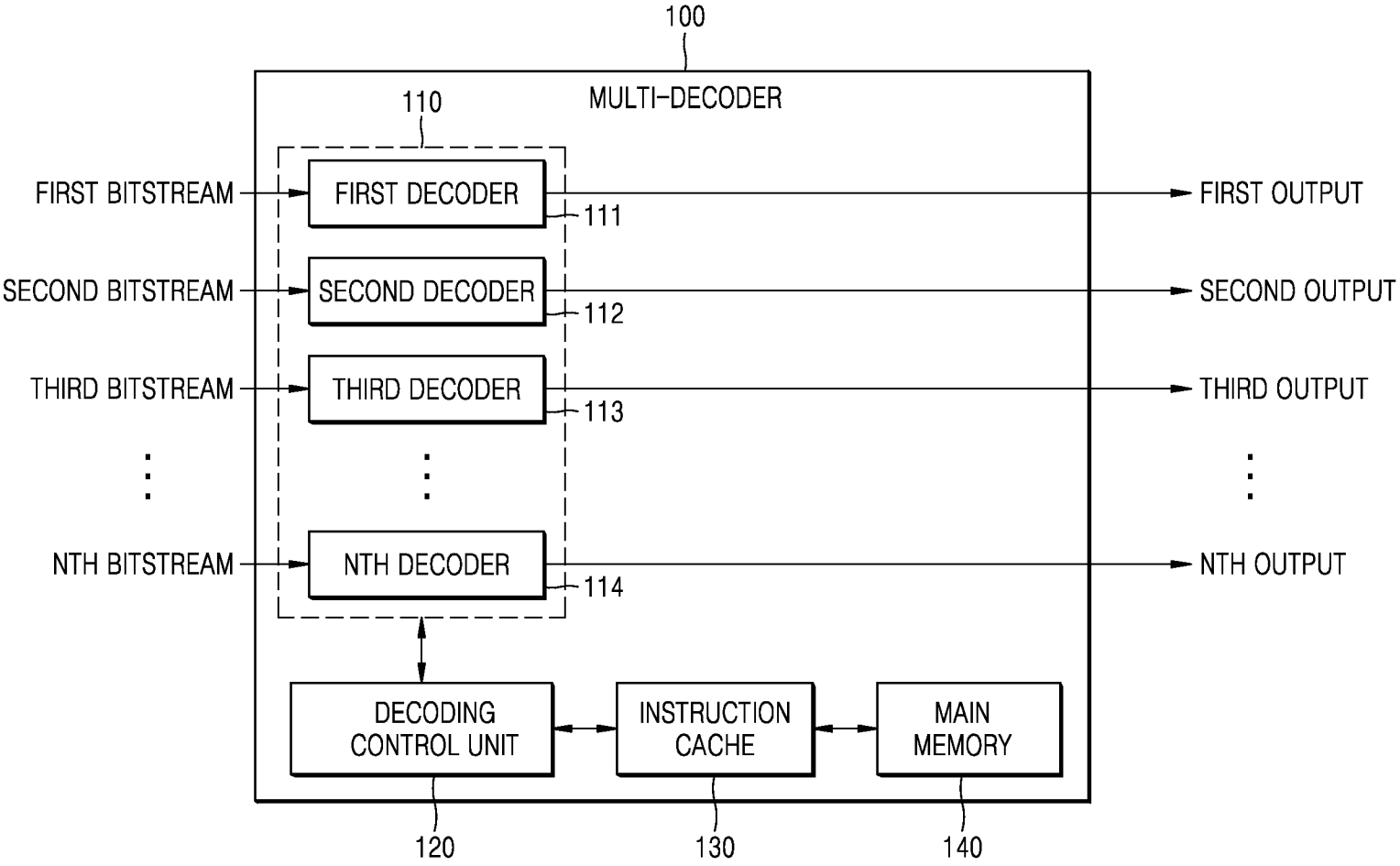
FIG. 1 is a diagram showing a configuration of a multi-decoder according to an embodiment of the present invention.

A multi-decoding method according to an embodiment of the present invention for solving the technical problems may include: receiving a plurality of bitstreams; dividing decoding modules for decoding the plurality of bitstreams according to a data amount of an instruction cache; and cross-decoding the plurality of bitstreams using each of the divided decoding modules.

Here, the cross-decoding of the plurality of bitstreams may include consecutively decoding two or more bitstreams among the plurality of bitstreams using any one of the divided decoding modules.

Also, the cross-decoding of the plurality of bitstreams may include consecutively decoding the two or more bitstreams among the plurality of bitstreams using instruction codes cached in the instruction cache to execute the any one of the divided decoding modules.

Also, the cross-decoding of the plurality of bitstreams may include: caching some of instruction codes stored in a main memory to the instruction cache to execute any one of the divided decoding modules; consecutively decoding two or more bitstreams among the plurality of bitstreams using the cached instruction codes; and caching some of the instruction codes stored in the main memory to the instruction cache to execute another one of the divided decoding modules.

Also, the instruction codes may be stored in the main memory according to a processing sequence of the decoding modules.

Also, the cross-decoding of the plurality of bitstreams may include cross-decoding the plurality of bitstreams in units of frames of the plurality of bitstreams.

Also, the dividing of the decoding modules may include not dividing the decoding modules when data amounts of the decoding modules are equal to or smaller than the data amount of the instruction cache.

Also, the dividing of the decoding modules may include dividing the decoding modules into a plurality of modules having data amounts equal to or smaller than the data amount of the instruction cache when data amounts of the decoding modules are larger than the data amount of the instruction cache.

Also, the plurality of bitstreams may include bitstreams of one main audio signal and at least one associated audio signal.

A multi-decoder according to another embodiment of the present invention for solving the technical problems may include: a plurality of decoders configured to separately decode a plurality of bitstreams; a main memory in which instruction codes necessary for decoding the plurality of bitstreams are stored; an instruction cache in which instruction codes required by respective decoding modules among the instruction codes stored in the main memory are cached; and a decoding control unit configured to divide the decoding modules according to a data amount of the instruction cache and perform control so that the plurality of decoders cross-execute each of the divided decoding modules.

Here, the decoding control unit may cause two or more decoders among the plurality of decoders to consecutively execute any one of the divided decoding modules.

Also, the decoding control unit may cause the two or more decoders among the plurality of decoders to consecutively perform decoding using instruction codes cached in the instruction cache to execute the one of the divided decoding modules.

Also, the decoding control unit may include: a decoding module division unit configured to divide the decoding modules and cache the instruction codes for executing the divided decoding modules from the main memory to the instruction cache; and a cross-processing unit configured to cause the plurality of decoders to perform cross-decoding using the instruction codes cached in the instruction cache for each of the divided decoding modules.

Also, when the decoding module division unit caches instruction codes corresponding to any one of the divided decoding modules in the instruction cache, the cross-processing unit may cause two or more decoders among the plurality of decoders to consecutively perform decoding using the instruction cache.

Also, the instruction codes may be stored in the main memory according to a processing sequence of the decoding modules.

Also, the cross-processing unit may control the plurality of decoders to perform the cross-decoding in units of frames of the plurality of bitstreams.

Also, the decoding module division unit may not divide the decoding modules when data amounts of the decoding modules are equal to or smaller than the data amount of the instruction cache.

Also, the decoding module division unit may divide the decoding modules into a plurality of modules having data amounts equal to or smaller than the data amount of the instruction cache when data amounts of the decoding modules are larger than the data amount of the instruction cache.

Also, the plurality of bitstreams may include bitstreams of one main audio signal and at least one associated audio signal.

MODE OF THE INVENTION

Hereinafter, embodiments of the present invention will be described in detail with reference to the drawings. To clearly describe the features of the present embodiments, detailed descriptions widely known to those of ordinary skill in the art to which the following embodiments pertain will be omitted.

FIG. 1 is a diagram showing a configuration of a multi-decoder according to an embodiment of the present invention. It is assumed below that a multi-decoder 100 according to an embodiment of the present invention decodes an audio signal. However, the scope of the present invention is not limited thereto.

Referring to FIG. 1, the multi-decoder 100 according to an embodiment of the present invention may include a decoder set 110 including a first decoder 111 to an Nth decoder 114, a decoding control unit 120, an instruction cache 130, and a main memory 140. Although not shown in FIG. 1, the multi-decoder 100 may further include general elements of a decoder, such as a sample rate converter (SRC) and a mixer.

The first decoder 111 to the Nth decoder 114 included in the decoder set 110 decode a first bitstream to an Nth bitstream, respectively. Here, a plurality of bitstreams may be bitstreams of one main audio signal and at least one associated audio signal. For example, a television (TV) broadcast signal which supports a sound-multiplex function may include one main audio signal output in basic settings and also at least one audio signal output upon a change of the settings, and such a plurality of audio signals are transmitted in separate bitstreams. In other words, the decoder set 110 also decodes a plurality of audio signals.

The decoding control unit 120 controls decoding of the plurality of decoders included in the decoder set 110. In an embodiment of the present invention, it is assumed that the decoding control unit 120 has a single-core processor. Therefore, it is possible to control only one decoder to operate at one time, and two or more decoders cannot be simultaneously operated. The assumption of a single-core processor is made to achieve the purpose of cost reduction. When the decoding control unit 120 has a multi-core processor, it is possible to cause the plurality of decoders to separately operate at one time. Therefore, the processing rate is increased, but costs rise. Consequently, embodiments of the present invention propose a method for reducing costs and also increasing a processing rate by improving a decoding structure even when a single-core processor is used.

The decoding control unit 120 caches instruction codes necessary for executing decoding modules from the main memory 140 to the instruction cache 130, and causes decoders to execute decoding modules using the instruction cache 130. Here, decoding modules represent units in which decoding is performed. For example, decoding modules may be obtained by dividing a whole decoding process according to functions for performing the whole decoding process. When decoding modules are divided according to functions, decoding modules may be separately configured to correspond to performing of Huffman decoding, dequantization, and filter banking. Needless to say, decoding modules are not limited thereto, and can be variously configured.

Meanwhile, the main memory 140 stores all instruction codes for performing decoding, and instruction codes necessary for executing a specific decoding module are cached from the main memory 140 to the instruction cache 130 according to the status of progress of a decoding process.

In general, a size, that is, a data amount, of the instruction cache 130 is smaller than a data amount of a decoding module, and thus a cache miss occurs during a process of executing one decoding module. Therefore, instruction codes should be cached, and a stall cycle occurs. For example, it is assumed that a data amount of the instruction cache 130 is 32 KB, and a data amount of a decoding module to be executed is 60 KB. First, instruction codes of 32 KB are cached from the main memory 140 to the instruction cache 130, and then a decoding process is performed for a bitstream. Subsequently, when the instruction cache 130 is searched for the remaining instruction codes of 28 KB, a cache miss occurs. Therefore, a stall cycle occurs during a process of caching the remaining instruction codes of 28 KB from the main memory 140 to the instruction cache 130.

In the case of processing a single stream signal, such stall cycles occur due to the limit of a data amount of an instruction cache, and it is difficult to reduce stall cycles through a change of a decoding process sequence, and so on. However, in the case of processing a multi-stream signal as in the present embodiment, the process should be repeated every time each bitstream is decoded, and thus the same instruction code is cached as many times as the number of bitstreams. Therefore, stall cycles corresponding to a multiple of the number of bitstreams occur. Consequently, in the case of a multi-stream signal, it is possible to reduce an occurrence of stall cycles through a change of a decoding process sequence, and so on.

The decoding control unit 120 divides decoding modules and appropriately controls an execution sequence of the divided decoding modules, thereby reducing stall cycles of the instruction cache which occur during decoding of a plurality of bitstreams. Specifically, the decoding control unit 120 divides decoding modules according to a data amount of the instruction cache 130, and cross-decodes a plurality of bitstreams using each of the divided decoding modules. That is, using any one of the divided decoding modules, the decoding control unit 120 consecutively decodes two or more bitstreams among the plurality of bitstreams, and thus can process the two or more bitstreams with one caching operation. In other words, the decoding control unit 120 consecutively decodes two or more bitstreams among the plurality of bitstreams using instruction codes which are cached in the instruction cache 130 to execute any one of the divided decoding modules. Division of decoding modules and cross-processing with divided decoding modules will be described in detail below.

Meanwhile, by storing instruction codes in the main memory 140 according to a processing sequence of decoding modules, it is possible to minimize duplicate caching of instruction codes, and thus a processing rate can be increased.

Figure 2:
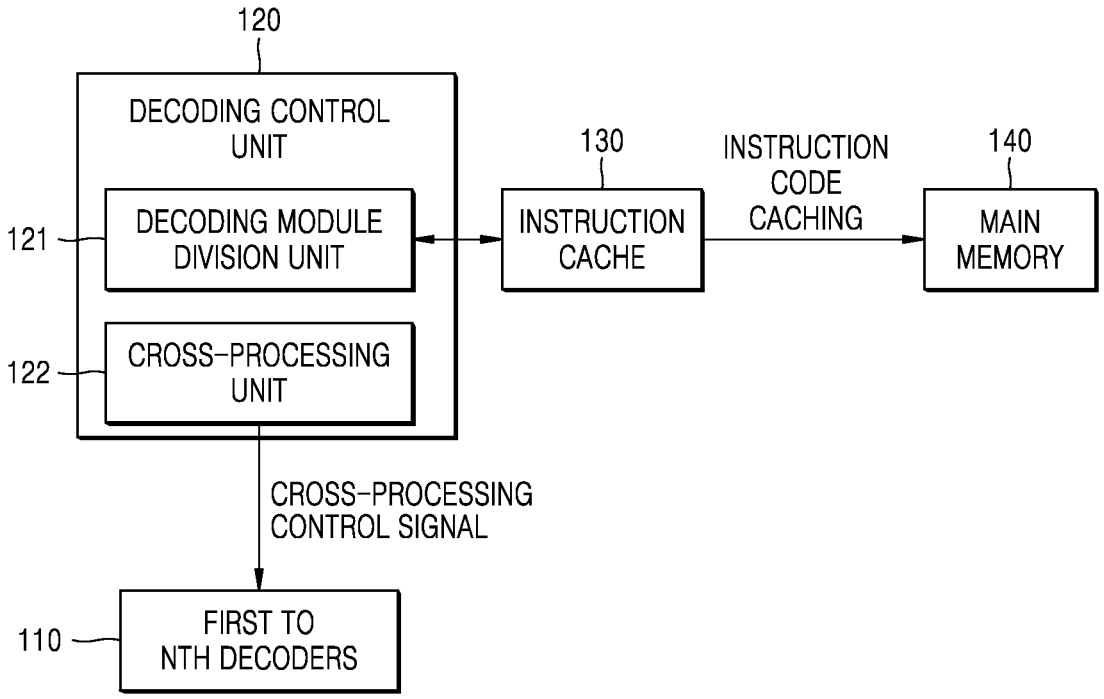
FIG. 2 is a diagram showing a detailed configuration of a decoding control unit in the configuration of the multi-decoder according to an embodiment of the present invention.

FIG. 2 is a diagram showing a detailed configuration of the decoding control unit 120 of FIG. 1. Referring to FIG. 2, the decoding control unit 120 may include a decoding module division unit 121 and a cross-processing unit 122.

The decoding module division unit 121 divides decoding modules according to a data amount of the instruction cache 130. Also, the decoding module division unit 121 caches instruction codes required by the divided decoding modules from the main memory 140 to the instruction cache 130.

The cross-processing unit 122 controls the decoder set 110 including the first to Nth decoders so that a plurality of bitstreams can be cross-decoded using each of the divided decoding modules.

A detailed method in which the decoding module division unit 121 and the cross-processing unit 122 divide decoding modules and perform cross-decoding will be described in detail below with reference to FIGS. 3A to 4C.

Figure 3A:
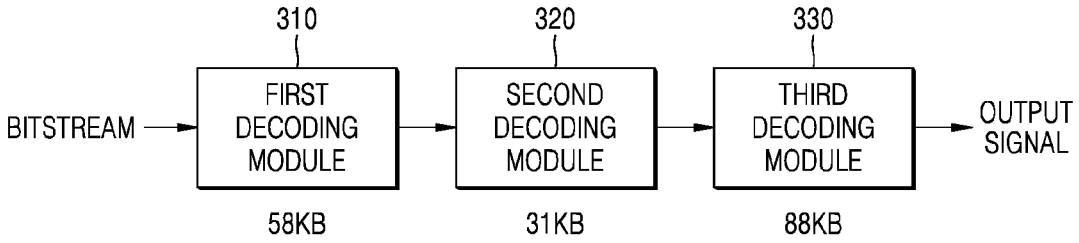
FIGS. 3A and 3B are diagrams illustrating a process of dividing decoding modules according to an embodiment of the present invention.
Figure 3B:
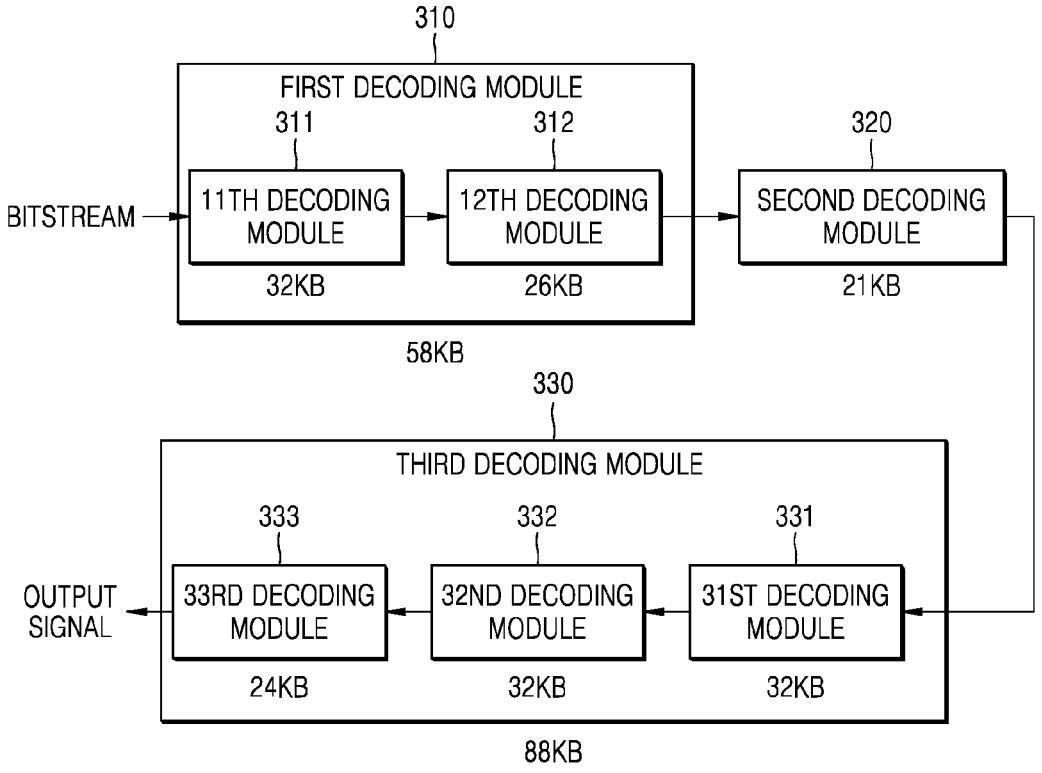

FIGS. 3A and 3B are diagrams illustrating a process of dividing decoding modules according to an embodiment of the present invention. Referring to FIG. 3A first, decoding modules before division are shown. A first decoding module 310, a second decoding module 320, and a third decoding module 330 are shown, and these decoding modules have data amounts of 58 KB, 31 KB, and 88 KB, respectively.

A result of dividing the decoding modules of FIG. 3A according to a data amount of the instruction cache 130 is shown in FIG. 3B. Here, the data amount of the instruction cache 130 is assumed to be 32 KB. Referring to FIG. 3B, the first decoding module 310 having a data amount of 58 KB is divided into an 11th decoding module 311 having a data amount of 32 KB and a 12th decoding module 312 having a data amount of 26 KB. Meanwhile, the second decoding module 320 having a data amount of 31 KB is not divided, and the third decoding module 330 having a data amount of 88 KB is divided into 31st and 32nd decoding modules 331 and 332 having a data amount of 32 KB and a 33rd decoding module 333 having a data amount of 24 KB.

In this way, by dividing decoding modules to have data amounts equal to or smaller than the data amount of the instruction cache 130, no cache miss occurs even when a plurality of bitstreams are consecutively decoded using the divided modules. Therefore, a method of dividing decoding modules needs to only satisfy a condition that data amounts of divided modules should be equal to or smaller than the data amount of the instruction cache 130. For example, in FIG. 3B, the first decoding module 310 is divided into the 11th decoding module 311 of 32 KB and the 12th decoding module 312 of 26 KB, but may be divided into two modules having a data amount of 29 KB unlike FIG. 3B. Similarly, the third decoding module 330 having a data amount of 88 KB may be divided into one module having a data amount of 30 KB and two modules having a data amount of 29 KB.

In brief, to prevent a cache miss during a process of consecutively decoding a plurality of bitstreams, the decoding module division unit 121 may divide decoding modules into modules having data amounts equal to or smaller than the data amount of the instruction cache 130.

When the decoding modules are divided according to the data amount of the instruction cache 130, the cross-processing unit 122 performs control so that a plurality of bitstreams are cross-decoded using each of the divided modules. For example, when the first decoder 111 of FIG. 1 decodes a first bitstream using the 11th decoding module 311 of FIG. 3B, the second decoder 112 then decodes a second bitstream using the 11th decoding module 311 too Immediately after the first bitstream is decoded using the 11th decoding module 311, instruction codes of 32 KB corresponding to the 11th decoding module 311 are kept stored in the instruction cache 130. Therefore, when the second bitstream is then decoded using the 11th decoding module 311, no cache miss occurs, and no stall cycle occurs.

Here, cross-decoding of a plurality of bitstreams may be implemented in various ways. For example, the first to Nth bitstreams may be consecutively decoded using the 11th decoding module 311 and then may be consecutively decoded using the 12th decoding module 312. Alternatively, first to third bitstreams may be consecutively decoded using the 11th decoding module 311 and then the first to third bitstreams are consecutively decoded using the 12th decoding module 312. When decoding of the first to third bitstreams is finished in this way, decoding of the next three bitstreams may be started using the 11th decoding module 311.

Meanwhile, the cross-processing unit 122 can perform the cross-processing of the plurality of bitstreams in units of frames, or can also perform the cross-processing in other units.

Figure 4A:
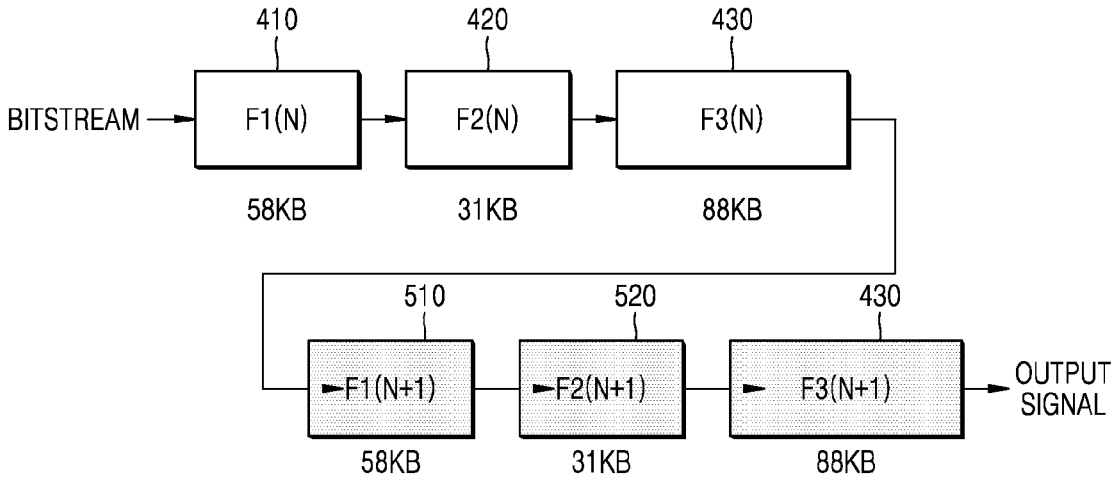
FIGS. 4A to 4C are diagrams illustrating a process of dividing decoding modules and cross-decoding a plurality of bitstreams according to an embodiment of the present invention.
Figure 4B:
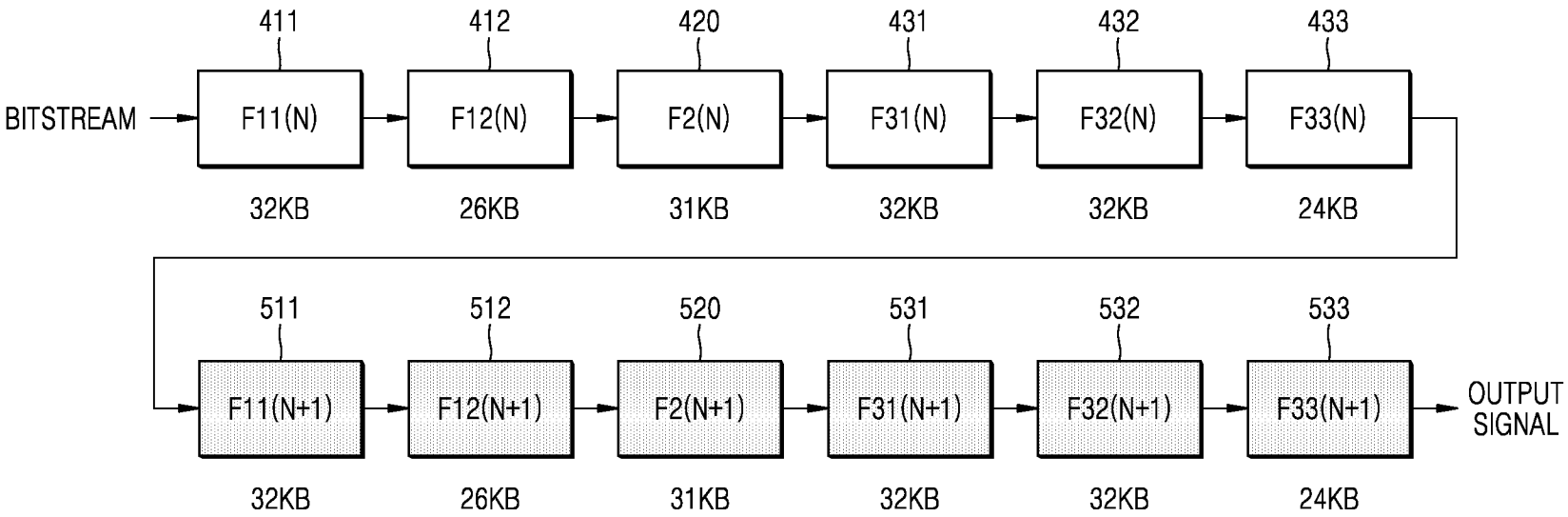
Figure 4C:
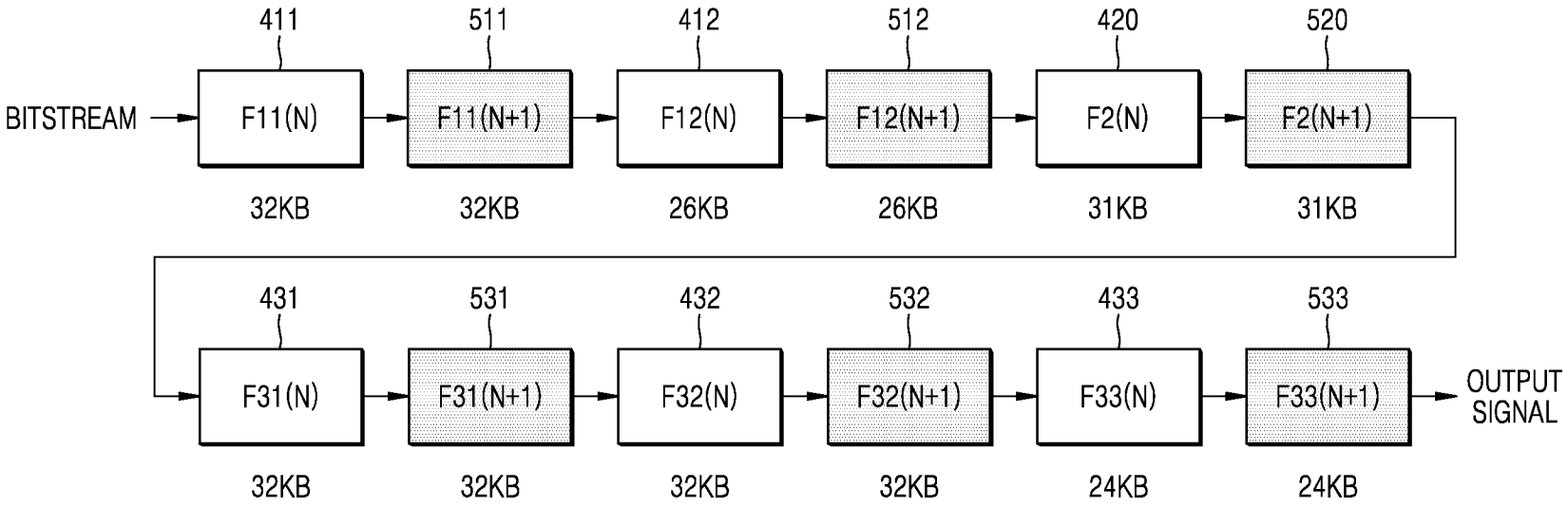

A detailed method of performing cross-decoding with divided decoding modules will be described below. FIGS. 4A to 4C are diagrams illustrating a process of dividing decoding modules and cross-decoding a plurality of bitstreams according to an embodiment of the present invention.

FIG. 4A shows a process of decoding frames N and N+1 of two different bitstreams before decoding modules are divided. Referring to FIG. 4A, decoding modules are configured as F1, F2, and F3, which have data amounts of 58 KB, 31 KB, and 88 KB, respectively. F1(N) 410, F2(N) 420, and F3(N) 430 decode the frame N of any one bitstream. F1(N+1) 510, F2(N+1) 520, and F3(N+1) 530 decode the frame N+1 of the other bitstream. When decoding is sequentially performed in this way, cache misses occurring upon decoding the frame N occur upon decoding the frame N+1 in the same manner, so that double stall cycles occur.

FIG. 4B shows a result of dividing each decoding module according to a data amount of an instruction cache. Here, the data amount of the instruction cache is assumed to be 32 KB. The decoding module F1 having a data amount of 58 KB is divided into F11 having a data amount of 32 KB and F12 having a data amount of 26 KB. The decoding module F2 having a data amount of 31 KB is not divided because the data amount is smaller than the data amount of the instruction cache. The decoding module F3 having a data amount of 88 KB is divided into F31 and F32 having a data amount of 32 KB and F33 having a data amount of 24 KB.

Here, although each of the decoding modules is divided into modules having a smaller data amount than the instruction cache, all of the decoding modules are executed for the frame N and then executed for the frame N+1. Consequently, the same stall cycle occurs as in FIG. 4A.

FIG. 4C shows an example of cross-decoding a plurality of bitstreams. Referring to FIG. 4C, F11(N) 411 is executed, and then F11(N+1) 511 is executed. In other words, the frame N is decoded using the module F11, and the frame N+1 is then decoded using the module F11 too. Since two frames are consecutively decoded using the same decoding module and the data amount of the decoding module does not exceed the data amount of the instruction cache, no cache miss occurs. In other words, instruction codes stored in the instruction cache upon processing the frame N can also be used as they are upon processing the frame N+1 so that no cache miss occurs.

Even in subsequent decoding processes, the two frames N and N+1 are consecutively decoded using each of the divided decoding modules, and thus occurrence of stall cycles is reduced, so that a processing rate is increased.

In this way, decoding modules are divided according to a data amount of an instruction cache, and a plurality of bitstreams are cross-decoded using each of the divided decoding modules, so that occurrence of cache misses is minimized and stall cycles are reduced. Therefore, it is possible to increase an overall decoding rate.

Also, by storing instruction codes in a main memory according to a sequence in which decoding modules are processed, it is possible to minimize duplicate caching of the instruction codes and increase a decoding rate.

Figure 5:
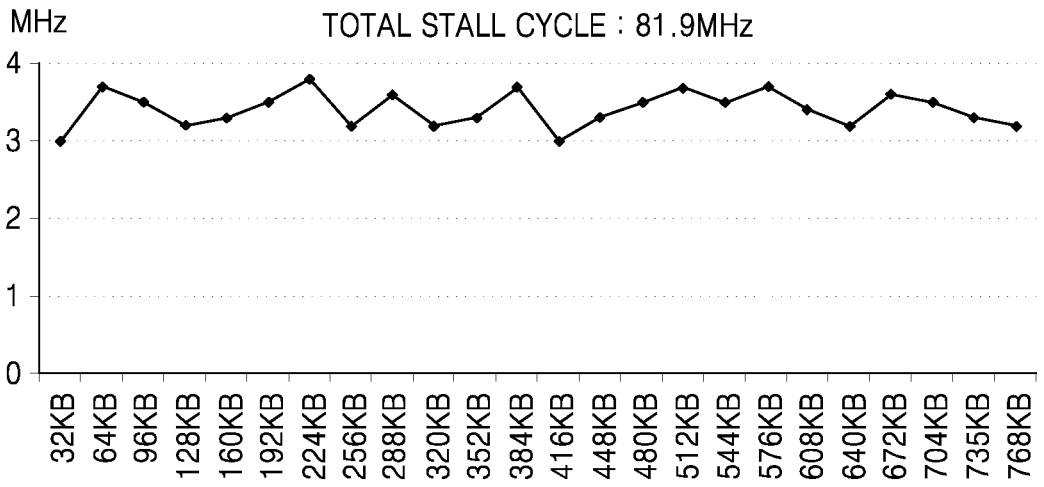
FIGS. 5 to 7 are graphs for comparing stall cycles of an instruction cache before and after a decoding method according to an embodiment of the present invention is applied.
Figure 6:
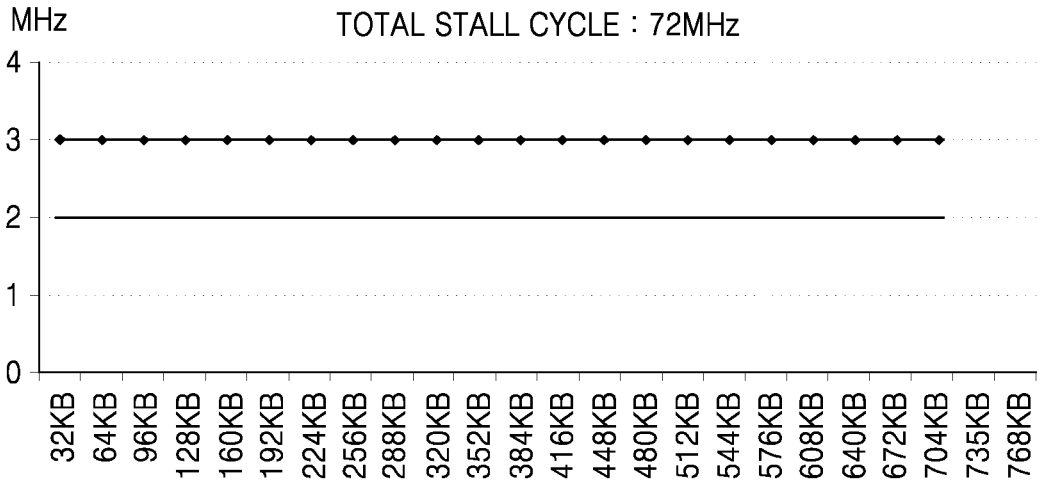
Figure 7:
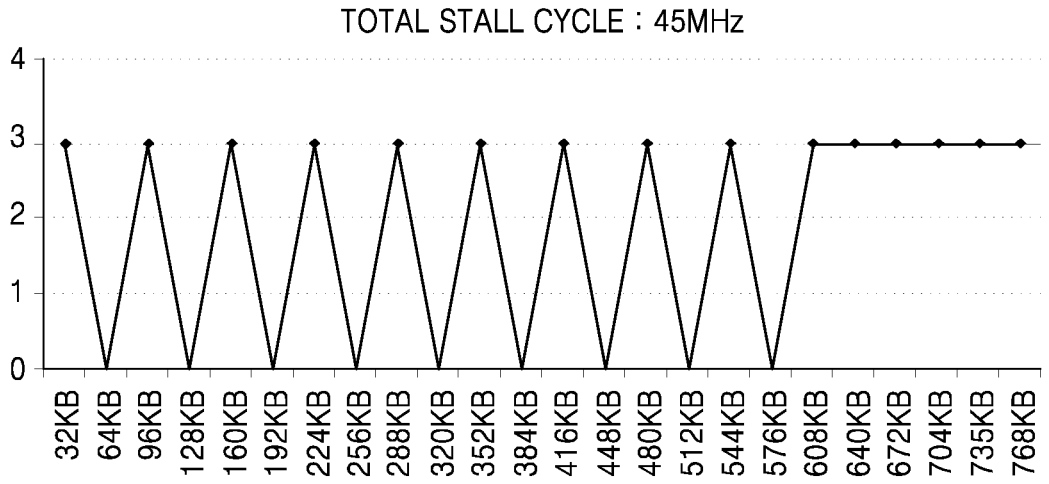

FIGS. 5 to 7 are graphs for comparing stall cycles of an instruction cache before and after a decoding method according to an embodiment of the present invention is applied.

FIG. 5 is a graph showing stall cycles occurring in a decoding process before a multi-decoding method according to an embodiment of the present invention is applied. The horizontal axis represents a data amount of instruction codes processed in the decoding process. Even in the present embodiment, a data amount of an instruction cache is assumed to be 32 KB. Referring to FIG. 5, it can be seen that a stall cycle occurs every 32 KBs, and sizes of occurring stall cycles are inconstant. The stall cycles result from inconsistency between a sequence of instruction codes stored in a main memory and an operation sequence of decoders. An instruction cache generally employs a multi-way cache method, and when instruction codes to be cached are not sequentially stored in a main memory, caching of the instruction codes may be duplicated due to a limitation of a position which can be loaded.

FIG. 6 is a graph showing stall cycles after a sequence of instruction codes stored in a main memory is arranged according to a sequence of processing decoding modules according to an embodiment of the present invention. Referring to FIG. 6, it can be seen that a stall cycle of 3 MHz occurs in every case in the same manner. Since no duplicate caching occurs, the same stall cycle occurs in every caching operation.

FIG. 7 is a graph showing stall cycles occurring when decoding is performed by applying the multi-decoding method according to an embodiment of the present invention. Here, a case of cross-decoding two bitstreams is assumed. Referring to FIG. 7, it can be seen that a stall cycle of 3 MHz occurs every time the amount of processed data doubles 32 KB, which is the data amount of the instruction cache. That is because, since two bitstreams are consecutively decoded using divided decoding modules having data amounts of 32 KB or less, stall cycles of 3 MHz occur due to caching of instruction codes during decoding of a first bitstream, but neither a cache miss nor a stall cycle occurs due to the instruction codes which are already stored in the instruction cache during decoding of a second bitstream. In this way, by cross-decoding two bitstreams with respective decoding modules, it is possible to reduce occurrence of stall cycles and, as a result, to increase an overall processing rate.

Figure 8:
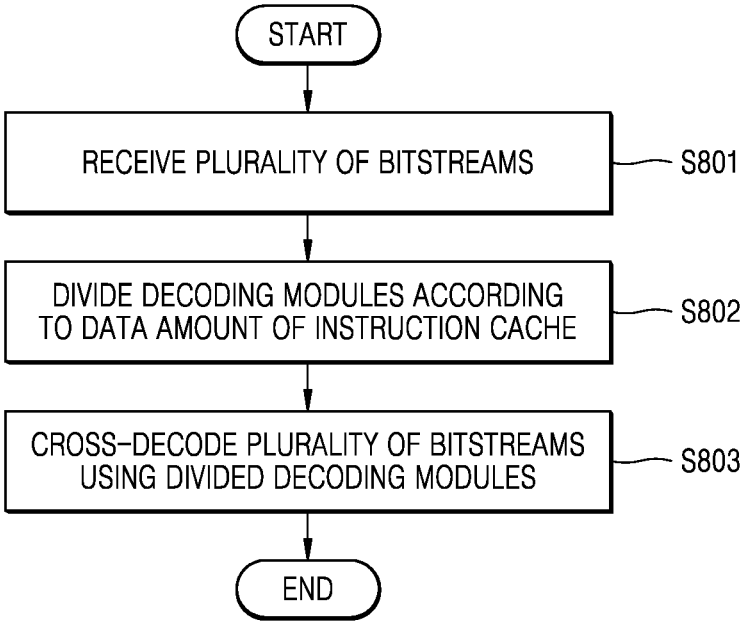
FIGS. 8 to 10 are flowcharts illustrating decoding methods according to embodiments of the present invention.
Figure 9:
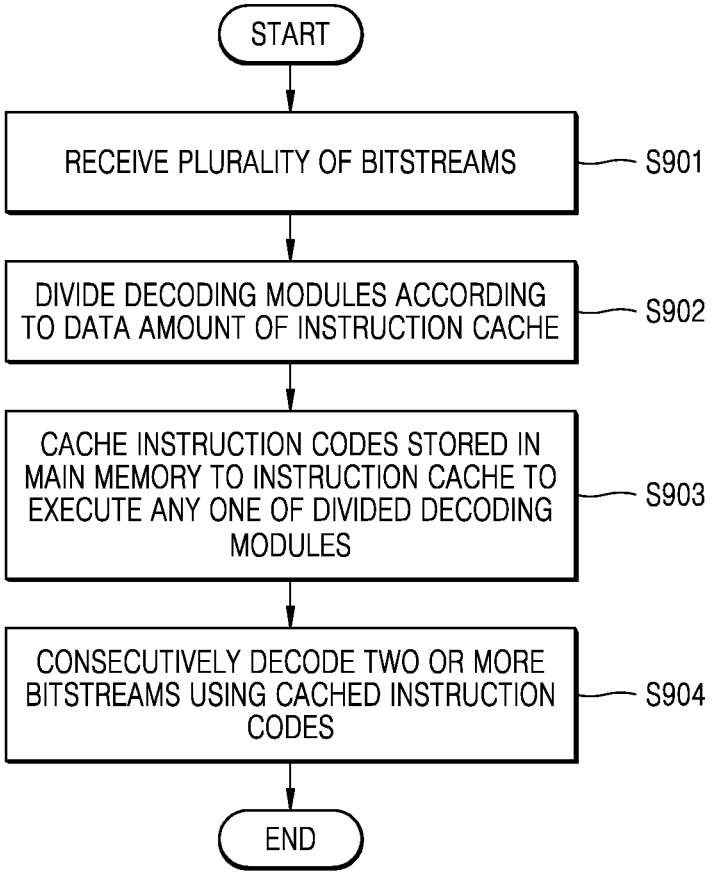
Figure 10:
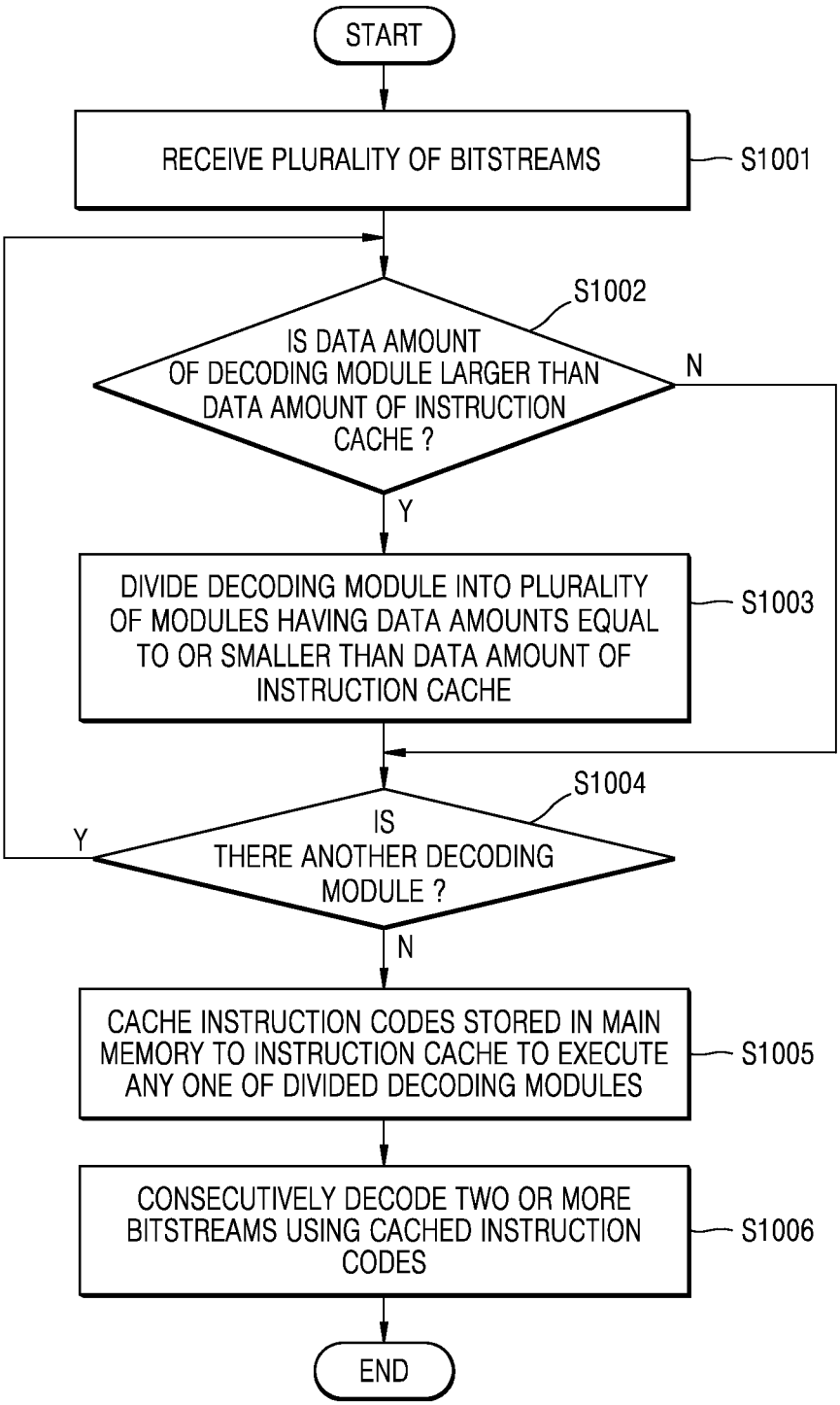

FIGS. 8 to 10 are flowcharts illustrating decoding methods according to embodiments of the present invention.

Referring to FIG. 8, in operation S801, a plurality of bitstreams are received. Here, the plurality of bitstreams may be bitstreams of one main audio signal and at least one associated audio signal. In operation S802, decoding modules for decoding the plurality of bitstreams are divided according to a data amount of an instruction cache. Here, decoding modules represent units in which decoding is performed. For example, decoding modules may be obtained by dividing a whole decoding process according to functions for performing the whole decoding process. Finally, in operation S803, the plurality of bitstreams are cross-decoded using the divided decoding modules.

Referring to FIG. 9, in operation S901, a plurality of bitstreams are received. In operation S902, decoding modules are divided according to a data amount of an instruction cache. For example, one decoding module is divided into a plurality of modules having data amounts which are equal to or smaller than the data amount of the instruction cache. In operation S903, instruction codes stored in a main memory are cached to the instruction cache to execute any one of the divided decoding modules. In operation S904, two or more bitstreams are consecutively decoded using the cached instruction codes.

Referring to FIG. 10, in operation S1001, a plurality of bitstreams are received. In operation S1002, it is determined whether a data amount of a decoding module is larger than a data amount of a instruction cache. When it is determined that the data amount of the decoding module is larger than the data amount of the instruction cache, the process proceeds to operation S1003, so that the decoding module is divided into a plurality of modules having data amounts equal to or smaller than the data amount of the instruction cache. However, when it is determined that the data amount of the decoding module is not larger than the data amount of the instruction cache, the process skips operation S1003 and proceeds to operation S1004. In operation S1004, it is determined whether there is another decoding module. When there is another decoding module, the process returns to operation S1002, and when there is not another decoding module, the process proceeds to operation S1005. In operation S1005, instruction codes stored in a main memory are cached in the instruction cache to execute any one of the divided decoding modules. Finally, in operation S1006, two or more bitstreams are consecutively decoded using the cached instruction codes.

In this way, decoding modules are divided according to a data amount of an instruction cache, and a plurality of bitstreams are cross-decoded using each of the divided decoding modules, so that occurrence of cache misses is minimized and stall cycles are reduced. Therefore, it is possible to increase an overall decoding rate.

Also, by storing instruction codes in a main memory according to a sequence in which decoding modules are processed, it is possible to minimize duplicate caching of the instruction codes and increase a decoding rate.

While the present invention has been particularly shown and described with reference to exemplary embodiments thereof, it will be understood by those of ordinary skill in the art that various changes in form and details may be made therein without departing from the spirit and scope of this invention. Therefore, the disclosed embodiments should be considered in descriptive sense only and not for purposes of limitation. The scope of this invention is defined not by the detailed description but by the appended claims, and all differences within the scope should be construed as being included in this invention.

The invention claimed is:

1. A multi-decoding method comprising:

receiving a plurality of bitstreams;

dividing decoding modules for decoding the plurality of bitstreams according to an amount of data of an instruction cache; and cross-decoding the plurality of bitstreams using each of the divided decoding modules.

2. The multi-decoding method of claim 1, wherein the cross-decoding of the plurality of bitstreams comprises consecutively decoding two or more bitstreams among the plurality of bitstreams using any one of the divided decoding modules.

3. The multi-decoding method of claim 2, wherein the cross-decoding of the plurality of bitstreams comprises consecutively decoding the two or more bitstreams among the plurality of bitstreams using instruction codes, which are cached in the instruction cache to execute the any one of the divided decoding modules.

4. A non-transitory computer-readable recording medium storing a program for causing a computer to perform the method of claim 2.

5. A non-transitory computer-readable recording medium storing a program for causing a computer to perform the method of claim 3.

6. The multi-decoding method of claim 1, wherein the cross-decoding of the plurality of bitstreams comprises:

caching some of instruction codes stored in a main memory to the instruction cache to execute any one of the divided decoding modules;

consecutively decoding two or more bitstreams among the plurality of bitstreams using the cached instruction codes; and caching some of the instruction codes stored in the main memory to the instruction cache to execute another one of the divided decoding modules.

7. A non-transitory computer-readable recording medium storing a program for causing a computer to perform the method of claim 6.

8. A non-transitory computer-readable recording medium storing a program for causing a computer to perform the method of claim 1.

9. A multi-decoder comprising:

a plurality of decoders configured to separately decode a plurality of bitstreams, each decoder including at least one decoding module;

a main memory in which instruction codes necessary for decoding the plurality of bitstreams are stored;

an instruction cache in which instruction codes required by respective decoding modules among the instruction codes stored in the main memory are cached; and a controller configured to divide the decoding modules according to an amount of data of the instruction cache and perform control so that the plurality of decoders cross-execute each of the divided decoding modules.

10. The multi-decoder of claim 9, wherein the controller causes two or more decoders among the plurality of decoders to consecutively execute any one of the divided decoding modules.

11. The multi-decoder of claim 10, wherein the controller causes the two or more decoders among the plurality of decoders to consecutively perform decoding using instruction codes, which are cached in the instruction cache to execute the any one of the divided decoding modules.

12. The multi-decoder of claim 9, wherein the controller is further configured to:

divide the decoding modules and cache the instruction codes for executing the divided decoding modules from the main memory to the instruction cache; and cause the plurality of decoders to perform cross-decoding using the instruction codes cached in the instruction cache for each of the divided decoding modules.

13. The multi-decoder of claim 12, wherein, when the controller caches instruction codes corresponding to any one of the divided decoding modules in the instruction cache, the controller causes two or more decoders among the plurality of decoders to consecutively perform decoding using the instruction cache.

14. The multi-decoder of claim 12, wherein the instruction codes are stored in the main memory according to a processing sequence of the decoding modules.

15. The multi-decoder of claim 12, wherein the controller controls the plurality of decoders to perform the cross-decoding in units of frames of the plurality of bitstreams.

16. The multi-decoder of claim 12, wherein the controller does not divide the decoding modules when data amounts of the decoding modules are equal to or smaller than the data amount of the instruction cache.

17. The multi-decoder of claim 12, wherein the controller divides the decoding modules into a plurality of modules having data amounts equal to or smaller than the amount of data of the instruction cache when data amounts of the decoding modules are larger than the data amount of the instruction cache.

18. The multi-decoder of claim 9, wherein the plurality of bitstreams include bitstreams of one main audio signal and at least one associated audio signal.

* * * * *